United States Patent [19]

Gock et al.

[11] Patent Number: 4,786,323

[45] Date of Patent: Nov. 22, 1988

[54] PROCESS FOR THE RECOVERY OF NOBLE METALS FROM ORE-CONCENTRATES

[76] Inventors: Eberhard Gock, Angerburger Allee 55, 1000 Berlin 19, Fed. Rep. of Germany; Elias Asiam, University of Science and Technology, Kumase, Ghana

[21] Appl. No.: 910,519

[22] Filed: Sep. 23, 1986

[30] Foreign Application Priority Data

Sep. 23, 1985 [DE] Fed. Rep. of Germany ..... 3534224

[51] Int. Cl.[4] ..... C22B 11/04

[52] U.S. Cl. ..... 75/118 R; 75/2; 75/97 A; 75/101 R; 75/106; 75/108; 75/115; 423/29; 423/34; 423/41; 423/42; 423/45; 423/87; 204/109

[58] Field of Search ..... 423/41, 29, 45, 34, 423/87, 42; 75/118 R, 101 R, 108, 97 A, 106, 115, 25; 204/109

[56] References Cited

U.S. PATENT DOCUMENTS

| | | | |
|---|---|---|---|
| 4,571,263 | 2/1986 | Weir et al. | 423/41 |
| 4,571,264 | 2/1986 | Weir et al. | 75/118 R |
| 4,610,724 | 9/1986 | Weir et al. | 423/87 |
| 4,615,731 | 10/1986 | Thomas et al. | 75/101 R |

FOREIGN PATENT DOCUMENTS

| | | | |
|---|---|---|---|
| 0914647 | 3/1982 | U.S.S.R. | 423/87 |

OTHER PUBLICATIONS

Ullmanns Enxyklopadie der Technischen Chemie, Verlag Chemie, Weinheim/Bergstr., 1974.

Pawlek, F., Metallhuttenkunde, Verlag Walter de Gruyter, Berlin, New York, 1983, p. 639.

Gerlach, J. et al., Einfluss des Gitteraufbaus von Metallverbindungen auf ihre Laugbarkeit, Erzmetall, 1972, p. 450.

Gold Recovery from Arsenopyrite by the Arseno Process, Western Miner, Mar. 1983, p. 21.

Gock, E., Measures for Reducing the Energy Requirement During Vibration Grinding, Jan. 20, 1979.

*Primary Examiner*—Robert L. Stoll

*Attorney, Agent, or Firm*—Collard, Roe & Galgano

[57] ABSTRACT

A process for the hydrometallurgical recovery of gold and silver by direct oxidizing sulphuric acid-digestion of arsenopyrite-concentrates ($FeAsS_2$) containing carbonaceous materials with a silicate gangue, and/or a silicate and pyrite gangue whereby arsenic and iron are fully solubilized and the noble metals are quantitatively enriched in the silicate-residue. The concentrate is subjected to mechano-chemical stress to produce structural deformations before being digested in the presence of oxygen. After decarbonization of the residue, gold and silver can be recovered by cyanide leaching without losses due to adsorption. A bulk process for preparing gold and silver rich concentrates is also disclosed.

36 Claims, 1 Drawing Sheet

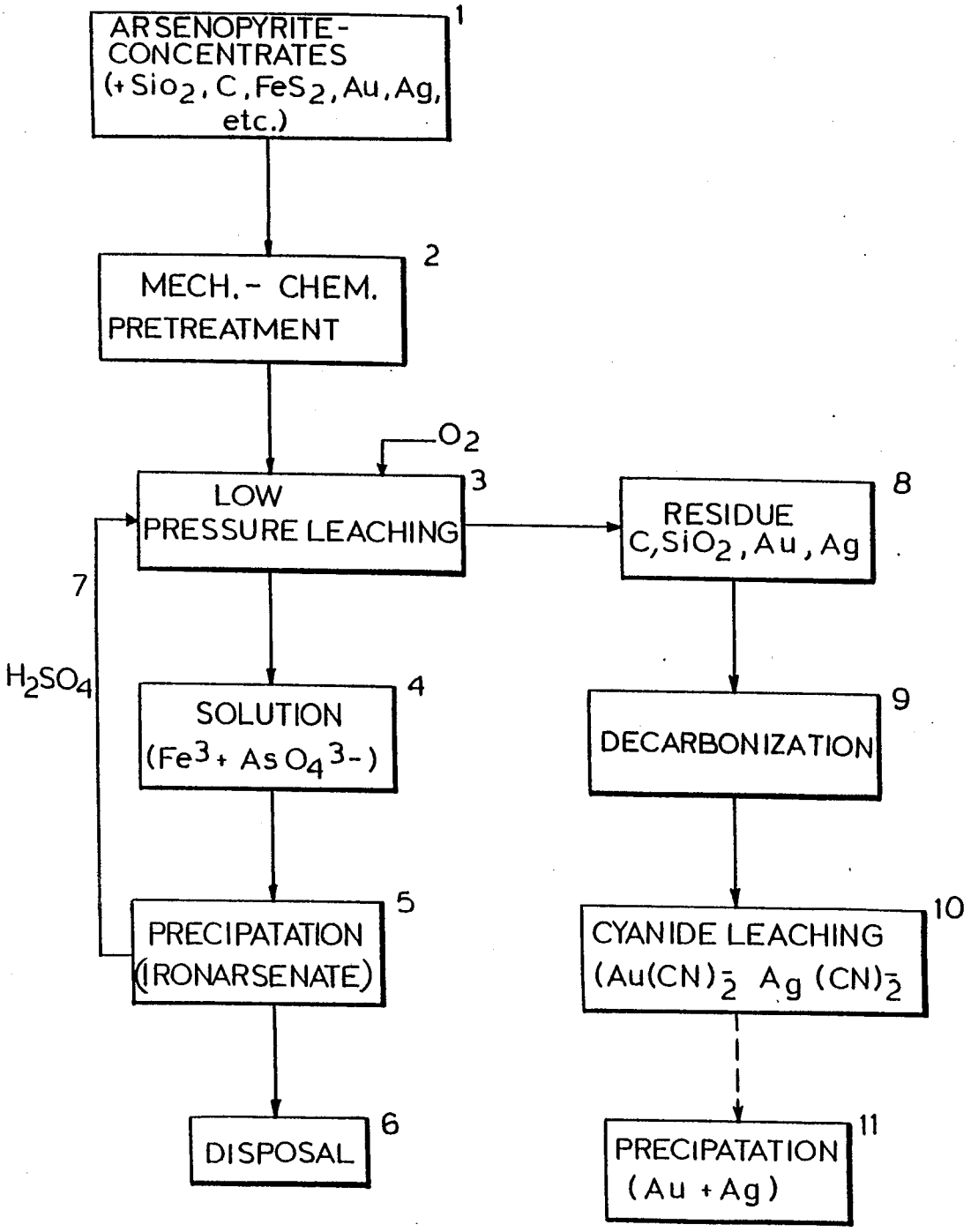
ARSENOPYRITE-CONCENTRATES (+SiO2, C, FeS2, Au, Ag, etc.)
1
MECH.- CHEM. PRETREATMENT
2
O2
LOW PRESSURE LEACHING
3
RESIDUE C, SiO2, Au, Ag
8
7
H2SO4
SOLUTION (Fe3+ AsO43-)
4
DECARBONIZATION
9
PRECIPATATION (IRONARSENATE)
5
CYANIDE LEACHING (Au(CN)2- Ag (CN)2-)
10
DISPOSAL
6
PRECIPATATION (Au + Ag)
11

PROCESS FOR THE RECOVERY OF NOBLE METALS FROM ORE-CONCENTRATES

BACKGROUND OF THE INVENTION

The invention relates to a hydrometallurgical recovery of gold and silver by direct oxidizing sulphuric acid-digestion of ore-concentrates, particularly arsenopyrite-concentrates ($FeAsS_2$) containing carbonaceous materials, with a silicate gangue, and/or a silicate and pyrite gangue. In the recovery, arsenic and iron are substantially fully solubilized and the noble metals are substantially quantitatively enriched together with the carbon of the carbonaceous materials in the silicate residue. After decarbonization of the residue gold and silver can be recovered substantially without losses due to adsorption by cyanide leaching and subsequent precipitation.

The normal method to recover gold and silver from arsenopyrites is to concentrate it by flotation. Arsenopyrites always contain silicates as gangue and depending on the type of ore, pyrite and carbonaceous materials such as graphite. Because the roasting process used nowadays for destroying sulphide matrix is thermally uncontrollable when carbonaceous materials are present, it is necessary to depress the carbonaceous materials during flotation to produce carbon-free aresenopyrite-concentrates. This works only partially and is out of the question when the carbon contains absorbed noble metals.

Arsenopyrites decompose in a temperature range between 500 and 800° C. To liberate the content of gaseous arsenic as $As_2O_3$, the arsenic and the arsenic sulphide in the gas phase have to be fully oxidized. Therefore, a low oxygen-pressure and a high $SO_2$-partial pressure are necessary in the roasting zone. An oxygen-pressure which is too high will produce metal-arsenates. The overall equation of the roasting process of arsenopyrite is:

$$4\ FeAsS + 10\ O_2 \rightarrow 2\ Fe_2O_3 + 2As_2O_3 + 4\ SO_2 \quad (1)$$

This technique has many disadvantages. First, the unavoidable emission of $SO_2$ and $As_2O_3$ means an unacceptable environmental pollution. On the other hand, the loss of gold due to dust discharge is (dependent on the temperature of roasting) more than 30%. At 802° C., a loss of gold of 33.7% has to be expected (see also: Ullmanns Enzyklopädie der Technischen Chemie, Verlag Chemie, Weinheim/Bergstr., 1974). There will be an additional loss of noble metals in the following cyanidation due to non-complete roasting because of arsenate- or ferroarsenate over production, and due to inclusion during the sintering of the resulting hematite ($Fe_2O_3$)

Many attempts have been made to replace the pyrometallurgical step of roasting arsenopyrite-concentrates by hydrometallurgical processes. One proposal is the oxidizing pressure-leaching of arsenopyrites in an autoclave using NaOH, an oxygen-pressure of 10 bar, and a temperature of 100° C. During this process, arsenic is transformed into water soluble $Na_3AsO_4$ and the sulphide is oxidized to sulphate. The leaching residue consists mainly of $Fe_2O_3$ and the noble metals (Pawlek, F., Metallhüttenkunde, Verlag Walter de Gruyter, Berlin, N.Y., 1983, p. 639).

This process has the disadvantage that the silicate gangue will be co-leached in the main, so that there will be problems with filtration of the solid/liquid separation due to gel formation. Additionally, the essentially amorphous resulting $Fe_2O_3$ has very good solubility, so that high reagent costs have to be expected for the anticipated dissolution of the metals in cholorine gas or cyanide solution.

The oxidative, acidic pressure digestion of arsenopyrites is generally not possible on the conditions known for alkaline digestion. On the one hand, the reaction rate is too slow, and on the other hand, a long reaction time causes hydrolysis with the formation of insoluble arsenates and the alkaline sulphates, which make the recovery of noble metals by cyanidation in the presence of carbonaceous materials impossible by adsorption (Gerlach, J. and others: EinfluB des Gitteraufbaus von Metallverbindungen auf ihre Laugbarkeit, Erzmetall, 1972, p. 450).

A new process by Stearns Catalytic Ltd. and Arseno Processing Ltd. (Gold recovery from arsenopyrite by the Arseno Process, Western Miner., March 1983, p. 21) discloses that the oxidizing, acidic pressure-digestion of pyrite-free arsenopyrite-concentrates is possible at temperatures of 100° C., when a catalyst is used. The conditions of reaction are an oxygen-pressure of 7 bar and a reaction time of 15 min. Although this method may be the best way of processing pyrite-free arsenopyrite-concentrates which contain gold, it has the following disadvantages:

1. The process depends on the use of a catalyst, which cannot be regenerated.

2. Sulphides will be oxidized only to elementary sulphur, which will of necessity mix with the silicate-gold residue during the solid-liquid-separation. During the following oxidizing cyanidation in a basic medium, the sulphur reacts with the oxygen to form thiosulphate, polysulphate, sulphate and sulphite. Less than 0.05 ppm of of sulphite ($S^2$) will reduce the recovery considerably (Adamson, R. I., Gold Metallurgy in South Africa, Cape + Transvaal Printers Ltd., 1972).

3. The carbonaceous materials and the gold are concentrated in the silicate residue. It is alleged that the carbonaceous materials are passivated during the process, so there will be no losses of gold due to adsorption during the following cyanidation. However, when the carbon is passivated, the amount of noble metal occluded in the carbon-particles is not recoverable by cyanidation, so that there will be losses in output.

4. Only when no pyrite is present, is it possible to keep the stated reaction conditions (100° C., 7 bar, 15 min.); at 100° C. and an oxygen-pressure of 8 bar, a maximum 20% of the total pyrite can be dissolved in 15 min. (Hähne, H.: Beitrag zur Drucklaugung von Eisensulfiden, Diss. TU Berlin, 1964). The removal of pyrite from arsenopyrite-concentrates requires another process-step (flotation). However, this is only possible when the pyrites are free from gold, which is mostly not the case.

5. Silver is found in the gold-containing residue as well as in the arsenic-iron-solution. The dissolved part is thus not recoverable and represents a heavy loss.

Accordingly, it is an object of the invention to provide a hydrometallurgical process for the recovery of gold and silver as well as a rich gold and rich silver containing, iron-, arsenic-, and carbon-free silicate concentrate, from ore concentrates, particularly from arsenopyrite concentrates, and, more particularly, from pyrite-containing arsenopyrite concentrates, which contain carbonaceous substances as well as silicates.

It is also an object of the invention to provide a process which enables a substantially quantitative yield of gold and silver containing, iron-, arsenic-, and carbon-free silicate concentrate under the most economical process conditions while largely avoiding environmental pollution.

SUMMARY OF THE INVENTION

Certain of the foregoing and related objects are readily attained in a process wherein ore concentrate, after a mechano-chemical treatment with an energy input of 50–500 kWh per ton of concentrate, is subjected to an oxidizing digestion in one step with, respectively, or without sulphuric acid, for a reaction time of between 15 minutes and 6 hours at temperatures of 50°–150° C. in the presence of oxygen at a partial pressure of 0.2–20 bar. As a result, the arsenic and iron fractions are substantially completely taken into solution while the gold, silver and carbonaceous substances enrich the silicate residue which is decarbonized at temperatures of 400°–1000° C. From this decarbonized concentrate, gold and silver can be extracted in a known manner by cyanide leaching and subsequent precipitation The cyanide leaching can be carried out for 3–10 hours.

It has now been found that, contrary to established teaching, a direct sulphuric acid digestion of noble-metal-containing arsenopyrite-concentrates, which contain both silicate gangue and carbonaceous materials, in the presence of oxygen in one step at the given temperatures, is possible if the ore concentrate is mechanochemically pretreated. By mechanochemical pretreatment, a change of symmetry results from the naturally occurring triclinic arsenopyrite to monoclinic and the carbon-containing part will have a lowered flashpoint. The stable sulphate solutions from the digestion contain the forerunning arsenic and iron. Gold and silver will be found quantitatively (together with the silicate gangue and the carbonaceous material) in the residue. Due to activation, the carbon-containing fraction in the noble metal residue can be fully decarbonized at temperatures which lie far below normal flashpoints for carbonaceous materials. Therefore, losses of noble metals due to adsorption can be substantially eliminated during the following cyanide leaching.

It has been further found that arsenopyrite concentrate containing noble metals and which include silicates, carbonaceous gangue, and pyrite as an associated mineral can be digested in the presence of oxygen in one step as well, when there is a mechano-chemical preparation. This preparation will cause changes in structure for pyrite as well as for arsenopyrite. These structure changes are characterized by sulphur deficiency in the lattice. The conditions of the oxidizing digestion of pyrite-containing arsenopyrite-concentrates are determined by the reactivity of pyrite in this case.

In contrast to the minimum necessary reaction temperature of 140° C. which is known from scientific investigations about complete acidic, oxidizing pressure-leaching of pyrite, (Hähne, H., see above), it was found, that a full digestion of the pyrite-part of arsenopyrite concentrates can be reached at a temperature of 100° C. without addition of sulphuric acid. Under these conditions, the forerunning gold and silver will be found practically quantitatively in the silicate residue.

Vibratory milling is especially suitable for the mechano-chemical preparation, because the exerted stress is mainly an impact stress at accelerations up to 15 g and point temperatures greater than 800° C. At 800° C., arsenopyrites undergo an extensive structural transformation from the triclinic to monoclinic symmetry. The accompanying minerals pyrite, quartz, and carbon are transformed by lattice dislocations and/or lattice vacancies to active, unstable states. This effect of the mechano-chemical structural transformation on the solubility of the arsenopyrite-concentrates, which is important to the invention, can be proven to be reproducible by X-ray microstructure.

Accordingly, vibratory mills can be looked upon as physico-chemical reactors (Gock, E.: MaBnahmen zur Verringerung des Energiebedarfs bei der Schwingmahlung, Aufbereitungstechnik, 1979, pp. 343–347). An energy input for the vibratory milling of 100–200 kWh/t of ore concentrate has been found to be particularly advantageous for the process according to the invention.

When using conventional milling in which there is much more rubbing than impact stress, the energy for causing changes in structure will not generally suffice to achieve a full digestion of arsenopyrite-concentrates under these conditions.

Within the framework of the process according to the invention, it is of great importance that the flashpoint of the carbon in the silicate residue be depressed.

The effect obtained by mechano-chemical structure changes of arsenopyrite concentrates is dependent on the concentration of the mineral components, on the operating conditions in the mill, and on the duration of milling, and it is therefore dependent on the expenditure of energy per ton of concentrate. If a long digestion time is acceptable for process engineering, a short milling time will be sufficient. With regard to the volume of the digestion reactor, it is advantageous to keep the time of reaction as short as possible. A reaction time of 15–240 minutes has been found to be particularly advantageous. Preferably, vibratory-milling will be employed in such a way that the ascertained ratios of X-ray diffraction intensity I/Io for arsenopyrite and the companion minerals quartz and pyrite are at least smaller than 0.4.

Other objects and features of the present invention will become apparent from the following detailed description considered in connection with the accompanying drawing, which discloses one embodiment of the invention. It is to be understood that the drawing is to be used for the purpose of illustration only, and not as a definition of the limits of the invention.

BRIEF DESCRIPTION OF THE DRAWING

The drawing is a schematic illustration of the process according to the invention.

DETAILED DESCRIPTION OF THE DRAWING

Turning now in detail to the appended drawing, therein illustrated is a novel metals extraction process wherein according to the process, it is possible (after mechano-chemical preparation in accordance with the invention by means of continuous vibratory-milling (2)), to digest metal-containing arsenopyrite-concentrates, with any proportion of silicate gangue and carbonaceous materials (1) for example by low-pressure leaching (3) with sulphuric acid at temperatures of 60° C.–120° C., most advantageously at 60° C.–100° C., and an oxygen partial pressure of 0.2–10 bar with a reaction time of 15–240 min. Then the arsenic and iron will be fully carried over in solution (4) and gold and silver will be effectively concentrated in the residue (8) containing also the silicate and carbonaceous materials and thus form a noble metal concentrate. When pyrite is present as an additional associated mineral, it will determine the conditions of reaction. The process needs no heat input, because the dissolution is an exothermic reaction. In general, it is not necessary to add any sulphuric acid when a cyclic process is installed, because the sulphides will be oxidized extensively to sulphate. After the solid-liquid separation, the noble metal-concentrate can be decarbonized, for example, by annealing, preferably at 500° C.–600° C. (9), because of the activated state of the carbonaceous material. In this way, noble metal losses by adsorption in the subsequent cyanide leaching are largely prevented. Gold and silver can be recovered by the well-known process of cyanidation (10) from the decarbonized concentrate.

Compared to the cyanidation of roasted arsenopyrite-concentrates, which can require leaching time of up to 60 hours, reaction times needed for the practically quantitative extraction of gold and silver out of these concentrates by the process according to the invention are from 3 to a maximum of 10 hours. The recovery of gold and silver from the cyanide-solution can be managed for example by using the CIP-Process with subsequent precipitation (11) by electrolysis or by zinc metal. The filtrate from the pressure leaching step will contain the whole forerunning arsenic and iron in the form of $Fe^{3+}$- and $AsO_4^{3-}$-ions (4).

By raising the pH of the solution, insoluble iron arsenate will be precipitated (5) for disposal (6) and/or for use as a starting material for the thermal extraction of arsenic. The liberated sulphuric acid will be recirculated (7) to the low-pressure leaching step (3).

The invention will be further described by the following examples, which are given by way of illustration and not of limitation.

EXAMPLE 1

A pyrite-free arsenopyrite-flotation-concentrate of the composition:

27.68% As
20.42% Fe
29.30% $Sio_2$
7.41% C
410 g Au/t and 1126 g Ag/t, which corresponds to a mineralogical composition of about 60% FeAsS, 30% $SiO_2$ and 7.4% C, was prepared by vibratory-milling with an energy input of 120 kWh/t.

The extent of structure changes or of produced lattice defects, which is expressed by the ratio of average X-ray diffraction intensities before (Io) and after (I) mechano-chemical preparation, was for arsenopyrite 0.4 and representative for the companion minerals $\alpha$-$Sio_2$=0.4.

The digestion was carried out in a laboratory autoclave with a ratio between suspension- and gas-volume of 1 : 2.5 with a solids content of 150 g/l under the following reaction conditions:

Temperature: 60° C.
Oxygen-partial pressure: 0.2 bar
$H_2SO_4$-starting-concentration: 140 g/l
Reaction time: 240 min.

After the solid-liquid separation the following concentrations were reached:

| | | |
|---|---|---|
| Solution | 98.5% Fe, | 98.9% As |
| Residue | 97.6% $SiO_2$ | 100% C, 100% Au + Ag |

The residue, which contains a lot of carbon, was dried at 100° C. and afterwards annealed in the presence of atmospheric oxygen at 500° C. for 60 min. The residue was fully decarbonized during this procedure. With reference to the feed, an enrichment by a factor 3.4 for gold and silver in the silicate residue was found. A subsequent cyanidation of this noble metal-concentrate led to a full extraction of gold and silver after a leaching time of only 4 hours. Without decarbonization, there would be losses of noble metals of up to 70% after the same leaching time.

EXAMPLE 2

The pyrite-free arsenopyrite-flotation-concentrate described in Example 1 was digested (after the same mechanochemical preparation by vibratory-milling) in a laboratory autoclave with the mentioned ratio of volume with a solids content of 150 g/l under the following conditions:

Temperature: 100° C.
Oxygen-partial pressure: 10 bar
$H_2SO_4$-starting concentration: 140 g/l
Reaction time: 60 min.

After the solid-liquid separation the following concentrations were found:

| | |
|---|---|
| Solution | 99.9% Fe, 99.4% As |
| Residue | 95.2% $SiO_2$, 100% C, 100% Au, 98.4% Ag |

In this case, decarbonization was carried out at 600° C. over a time period of 10 min. The result was a full decarbonized noble metal pre-concentrate, which showed the same good leaching behavior in the following cyanidation.

EXAMPLE 3

A pyrite-containing arsenopyrite-flotation concentrate of the composition:

15.64% As
30.24% Fe
19.80% $SiO_2$
4.4% C.
320 g Au/t+24 g Ag/t which corresponds to a mineralogical composition of about 34% FeAsS, 40% $FeS_2$, 20% $SiO_2$, and 4.4% C., was mechano-chemically prepared with an energy input of 180 kWh/t in a vibratory mill. The extent of structural change of produced lattice defects, which is expressed by the ratio of average X-ray diffraction intensities I/Io, was found to be 0.2 for arsenopyrite and 0.2 for $\alpha$-$SiO_2$ (representative for the gangue). The reactor for the digestion was a laboratory autoclave with the volume-ratio given in the preceding Examples.

The solids concentration was again 150 g/l. It was processed out under the following reaction conditions:

| | |
|---|---|
| Temperature | 110° C. |
| Oxygen-partial pressures: | 15 bar |
| An $H_2SO_4$ concentration builds up during the reaction | |

-continued

| | |
|---|---|
| Reaction time: | 30 min. |

After the solid-liquid separation the following output was obtained:

| | |
|---|---|
| Solution | 99.2% Fe, 99.5% As |
| Residue | 94% $SiO_2$, 100% C, 100% Au, 96.3% Ag |

The decarbonization of the residue, which was rich in noble metals, was carried out for 15 min. at 600° C. in an air flow. The factor of enrichment of gold and silver was found to be 5.05. The leaching of this noble metal pre-concentrate with NaCN enabled, after a reaction time of 5 hours, a complete extraction of gold and silver.

EXAMPLE 4

The pyrite-containing arsenopyrite-flotation concentrate described in Example 3 and prepared mechanochemically in the same way by vibratory-milling was leached in the laboratory autoclave with a solids content of 150 g/l under the following conditions:

| | |
|---|---|
| Temperature | 120° C. |
| Oxygen-partial pressure: | 20 bar |
| An $H_2SO_4$ concentration builds up during the reaction | |
| Reaction time: | 15 min. |

After the solid-liquid separation the following output was obtained:

| | |
|---|---|
| Solution | 98.7% Fe, 99.2% As |
| Residue | 95.7% $SiO_2$, 100% C, 100% Au, 96.9% Ag |

Decarbonization was carried out again at 600° C. The excellent reactive behavior during cyanidation described in the preceding examples was confirmed.

Thus, while only a single embodiment and several examples have been shown and/or described, it is obvious that many changes and modifications may be made thereunto, without departing from the spirit and scope of the invention.

What is claimed is:

1. A process for the wet-chemical recovery of gold and silver from pyrite-free arsenopyrite ore concentrates, which, in addition to silicatic gangue, particularly carry carbon-containing substances, by means of cyanide leaching of the carbon-free residue of the acid decomposition and subsequent precipitation of the noble metals, comprising the steps of:

mechano-chemically treating by vibratory milling the ore concentrates with predominantly impact-stressing with an energy expenditure of 50 to 500 kWh/ton ore concentrate;

oxidizingly decomposing said ore concentrate, in one step, with sulfuric acid with a reaction duration of from 15 minutes to 6 hours at temperatures from 50° to 150° C. in the presence of oxygen with a partial pressure of 0.2 to 20 bar, whereby the arsenic and iron components are almost completely solubilized, whereas the gold, silver and carbon-containing substances almost completely accumulate in the silicatic residue; and decarbonizing the silicate residue at temperatures from 400° to 1000° C.

2. A process according to claim 1, wherein the duration of the oxidizing decomposition is from 15 to 240 minutes.

3. A process according to claim 1, wherein for the mechano-chemical treatment with predominantly impact-stressing, the energy requirement is from 100 to 300 kWh/ton ore concentrate.

4. A process according to claim 1, wherein the oxidizing decomposition takes place at temperatures between 60° and 100° C.

5. A process according to claim 1, wherein the oxidizing decomposition is carried out at a low oxygen pressure between 0.2 and 10 bar.

6. A process according to claim 1, wherein the oxidizing decomposition takes place at elevated temperatures between 100° and 120° C.

7. A process according to claim 1, wherein the oxidizing decomposition takes place at low pressure in the range of 10 and 20 bar oxygen partial pressure.

8. A process according to claim 1, wherein the decarbonized silicatic, gold- and silver-containing residue is subjected to cyanide leaching for a duration of from 3 to 10 hours.

9. A process according to claim 1, wherein the noble metal-containing silicatic residues resulting from the decomposition are decarbonized at temperatures between 500° and 600° C.

10. A process for the wet-chemical recovery of gold and silver from pyrite-containing arsenopyrite ore concentrates, which, in addition to silicatic gangue, in particular carry carbon-containing substances, by means of cyanide leaching of the carbon-free residue of the decomposition and subsequent precipitation of the noble metals, comprising the steps of:

chemically treating by vibratory milling the ore concentrate with predominantly impact-stressing with an energy expenditure of 50 to 500 kWh/ton ore concentrate;

oxidizingly decomposing the ore concentrates, in one step, at temperatures from 50° to 150° C. and with a reaction duration of 15 minutes to 6 hours in the presence of oxygen with a partial pressure of 0.2 to 20 bar, whereby the arsenic and iron components are almost completely solubilized, whereas the gold, silver and carbon-containing substances almost completely accumulate in the silicatic residue; and decarbonizing the silicatic residue at temperatures from 400° to 1000° C.

11. A process according to claim 10, wherein the duration of the oxidizing decomposition is from 15 to 240 minutes.

12. A process acording to claim 10, wherein for the mechano-chemical treatment with predominantly shock-stressing, the energy requirement is from 100 to 300 kWh/ton ore concentrate.

13. A process according to claim 10, wherein the oxidizing decomposition takes place at temperatures between 60° and 100° C.

14. A process according to claim 10, wherein the oxidizing decomposition is carried out at a low oxygen pressure between 0.2 and 10 bar.

15. A process according to claim 10, wherein the oxidizing decomposition takes place at elevated temperatures between 100° and 120° C.

16. A process according to claim 10, wherein the oxidizing decomposition takes place at low pressure in the range of 10 and 20 bar oxygen partial pressure.

17. A process according to claim 10, wherein the decarbonized silicatic, gold- and silver-containing residue is subjected to cyanide leaching for a duration of from 3 to 10 hours.

18. A process according to claim 10, wherein the noble metal-containing silicatic residues resulting from the decomposition are decarbonized at temperatures between 500° and 600° C.

19. A process for the wet-chemical recovery of an iron-, arsenic, and cabon-free silicatic concentrates with gold and silver contents, from pyrite-free arsenopyrite concentrates which, in adition to silicatic gangue, in particular carry carbon-containing substances, comprising the steps of:

mechano-chemically treating by vibratory milling the arsenopyrite concentrate with predominantly impact-stressing with an energy expenditure of 50 to 500 kWh/ton ore concentrate;

oxidizingly decomposing the arsenopyrite concentrates, in one step, with sulphuric acid with a rection duration of 15 minutes to 6 hours at temperatures from 50° to 150° C. in the presence of oxygen with a partial pressure 0.2 to 20 bar, whereby the arsenic and iron components are almost completely solubilized, whereas the gold, silver and carbon-containing substances almost completely accumulate in the silicatic residue; and removing the carbon by heating to temperatures from 400° to 1000° C.

20. A process according to claim 19, wherein the duration of the oxidizing decomposition is from b -to 240 minutes.

21. A process according to claim 19, wherein for the mechano-chemical treatment with predominantly impact-stressing, the energy requirement is from 100 to 300 kWh/ton ore concentrate.

22. A process according to claim 19, wherein the oxidizing decomposition takes place at temperatures between 60° and 100° C.

23. A process according to claim 19, wherein the oxidizing decomposition is carried out at a low oxygen pressure between 0.2 and 10 bar.

24. A process according to claim 19, wherein the oxidizing decomposition takes place at elevated temperatures between 100° and 120° C.

25. A process according to claim 19, wherein the oxidizing decomposition takes place at low pressure in the range of 10 and 20 bar oxygen partial pressure.

26. A process according to claim 19, wherein the decarbonized silicatic, gold- and silver-containing residue is subjected to cyanide leaching for a duration of from 3 to 10 hours.

27. A process according to claim 19, wherein the noble metal-containing silicatic residues resulting from the decomposition are decarbonized at temperatures between 500° and 600° C.

28. A process for the wet-chemical recovery of an iron-, arsenic- and carbon-free silicatic concentrate with gold and silver contents, from pyrite-containing arsenopyrite concentrates which, in addition to silicatic gangue, particularly carry carbon-containing substances, comprising the steps of:

mechano-chemically treating by vibratory milling the arsenopyrite concentrates with predominantly impact-stressing with an energy expenditure of 50 to 500 kWh/ton ore concentrate;

oxidizingly decomposing the arsenopyrite concentrates, in one step, with a reaction duration of 15 minutes to 6 hours at temperatures from 50° to 150° C. in the presence of oxygen with a partial pressure of 0.2 to 20 bar, whereby the arsenic and iron components are almost completely solubilized, whereas the gold, silver and carbon-containing substances almost completely accumulate in the silicatic residue; and removing the carbon by heating at temperatures from 400° to 1000° C.

29. A process according to claim 28, wherein the duration of the oxidizing decomposition is from 15 to 240 minutes.

30. A process according to claim 28, wherein for the mechano-chemical treatment with predominantly impact-stressing, the energy requirement is from 100 to 300 kWh/ton ore concentrate.

31. A process according to claim 28, wherein the oxidizing decomposition takes place at temperatures between 60° and 100° C.

32. A process according to claim 28, wherein the oxidizing decomposition is carried out at a low oxygen pressure between 0.2 and 10 bar.

33. A process according to claim 28, wherein the oxidizing decomposition takes place at elevated temperatures between 100° and 120° C.

34. A process according to claim 28, wherein the oxidizing decomposition takes place at low pressure in the range of 10 and 20 bar oxygen partial pressure.

35. A process according to claim 28, wherein the decarbonized silicatic, gold- and silver-containing residue is subjected to cyanide leaching for a duration of from 3 to 10 hours.

36. A process according to claim 28, wherein the noble metal-containing silicatic residues resulting from the decomposition are decarbonized at temperatures between 500° and 600° C.

* * * * *